US005388840A

United States Patent [19]

Werle

[11] Patent Number: 5,388,840

[45] Date of Patent: Feb. 14, 1995

[54] THROWING DART FLIGHT WITH STEPPED CONFIGURATION

[76] Inventor: Sean F. Werle, 46 old Depot Rd., Hope Valley, R.I. 02832

[21] Appl. No.: 216,351

[22] Filed: Mar. 23, 1994

[51] Int. Cl.[6] ..... A63B 65/02

[52] U.S. Cl. ..... 273/423; D21/49

[58] Field of Search ..... 273/423, 420; D21/49

[56] References Cited

U.S. PATENT DOCUMENTS

| | | | |
|---|---|---|---|
| D. 180,007 | 4/1957 | Benkoe | D21/49 |
| 3,337,219 | 8/1967 | Saunders | 273/423 |
| 3,913,917 | 10/1975 | Coxon | 273/423 |
| 4,615,552 | 10/1986 | Bengtson | 273/423 |
| 4,988,112 | 1/1991 | Anderson et al. | 273/420 |
| 5,207,434 | 5/1993 | Oudekerk | 273/423 |

FOREIGN PATENT DOCUMENTS

| | | | |
|---|---|---|---|
| 2064967 | 6/1981 | United Kingdom | 273/423 |

*Primary Examiner*—Paul E. Shapiro
*Attorney, Agent, or Firm*—Barlow & Barlow Ltd.

[57] ABSTRACT

An improved dart flight with a stepped configuration on its leading and trailing edges is provided. The dart flight of the present invention enables a player to closely group darts with accuracy without unwanted deflection. The dart flight of the present invention includes a stepped configuration on the leading and trailing edges of both the horizontal and vertical vane components of the dart flight. When an incoming dart approaches a target in close proximity to a stationary dart already in the target, the leading stepped edge of the incoming dart communicates with the trailing stepped edge of the stationary dart to urge the dart flight on the incoming dart to be ejected from the shaft of the incoming dart. Since the dart flight is ejected, it cannot ride on the dart flight of the stationary dart to cause deflection and alteration of flight path. As a result, dart throwing accuracy can be maintained in close dart groupings.

3 Claims, 2 Drawing Sheets

THROWING DART FLIGHT WITH STEPPED CONFIGURATION

BACKGROUND OF THE INVENTION

The present invention relates generally to the game of darts. More specifically, the present invention relates to an improved dart flight for use on conventional dart bodies to prevent trajectory deviation upon communication with previously thrown darts which are present in the target, such as a dart board.

In the sport of darts, it has been well known to employ a metallic body, such as brass or titanium, with a pointed tip on one end and female threading on the other end. A dart shaft is available in many sizes and materials but typically has a male threaded end for insertion into the female end of the dart body and a number of slits at its opposite end for receipt of a dart flight therein. Usually the slits form a cross to receive a dart flight which has a horizontal vane component in a vertical component at right angles to one another. The dart flight is inserted into the slits on the free end of the shaft and is retained in place by a friction fit. This friction fit is tight enough to prevent the flight from dislodging from the slits in the shaft during normal flight.

The game of darts requires superior accuracy in throwing to excel in the game. The various target zones on a typical dart board are very small, for example, the double and triple point zones which form concentric rings on a board are less than an inch wide. Any deviation of the flight directory of an incoming dart will effect the thrower's ability to hit the desired target zone on the board.

In a conventional throwing dart of the prior art, the dart flights used have smooth edges both on the leading edge of the flight as well as the trailing edge of the flight. A problem arises when these prior art dart flights are used. When a dart which is carrying a prior art dart flight with smooth edges is thrown in close proximity to another dart already present in the target, often the leading smooth edge of the incoming dart directly communicates with a trailing edge of the dart flight of a dart already present in the target. When this communication occurs, the dart flight of the incoming dart tends to ride on the dart flight of the dart present in the target causing the overall trajectory of the incoming dart to be altered. The trajectory of an incoming dart may be deviated as much as three inches. Due to the precise nature of the game of darts, such trajectory deviation is unacceptable.

Due to the demand for accuracy in the game of darts, it is desirous for a dart player to be able to greatly improve his or her throwing accuracy and eliminate unwanted dart reflections which result from close groupings. Further, it is desirous for a dart player to be able to improve throwing accuracy and eliminate unwanted deflections without completely changing his or her dart body and shaft which he or she is accustomed to.

SUMMARY OF THE INVENTION

The present invention preserves the advantages of prior art dart flights. In addition, it provides new advantages not found in currently available dart flights, and overcomes many of the disadvantages of such currently available dart flights.

The invention is generally directed to a novel and unique dart flight for throwing darts with particular application in preventing the alteration of dart trajectory and unwanted deflections which result from a close grouping of darts in a target dart board. The improved dart flight of the present invention enables the simple and easy modification of known throwing darts by replacing inferior prior art dart flights with the improved dart flights of the present invention. The dart player still uses his present dart body and shaft but replaces the dart flight. Therefore, performance of the dart will not change but will result in a truer flight trajectory without deflections.

The preferred embodiment of the present invention includes a plurality of vane components emanating from a central axis. A vertical vane component and a horizontal vane component are preferably positioned at 90 degrees from one another. Each vane component has a leading edge and a trailing edge relative to the trajectory path of a dart being thrown into a target. The dart flight of the present invention is slidably insertable into the dart body and is capable of being retained therein by a friction fit. Each of the leading edges of the vane components of the dart flight have a plurality of notches therein. Each of the trailing edges of the vane components have a plurality of notches therein. Preferably, the notches on the leading and trailing edges of the vane components from a stepped configuration but may have other like configurations.

In operation, the player throws his first dart, which is carrying the dart flight of the present invention, into the target, such as a dart board. The player then throws a second dart which is identical to the first one, which also carries a dart flight of the present invention with stepped leading and trailing edges, toward the target. When the second dart is thrown in close proximity to the dart already present in the target, the leading stepped edge of the incoming dart communicates with the trailing stepped edge of the flight of the dart already in the dart board. As a result of this communication, the dart flight on the incoming dart is ejected off of the shaft of the incoming dart and the incoming dart, without a dart flight, continues forward into the target with its flight path undisturbed. As a result, accuracy of subsequently thrown darts is greatly improved.

It is therefore an object of the present invention to provide a dart flight that prevents the alteration of the flight path of an incoming dart into close proximity to another dart.

Another object of the present invention is to provide a dart flight that greatly improves dart throwing accuracy.

It is a further object of the present invention to provide a dart flight that enables a quick and easy solution to dart trajectory alterations and dart deflections without requiring the use of an entirely new throwing dart.

BRIEF DESCRIPTION OF THE DRAWINGS

The novel features which are characteristic of the present invention are set forth in the appended claims. However, the invention's preferred embodiments, together with the further objects and attendant advantages will be best understood by reference to the following detailed description taken in connection with the accompanying drawings in which:

DETAILED DESCRIPTION OF THE PREFERRED EMBODIMENT

Figure 1:
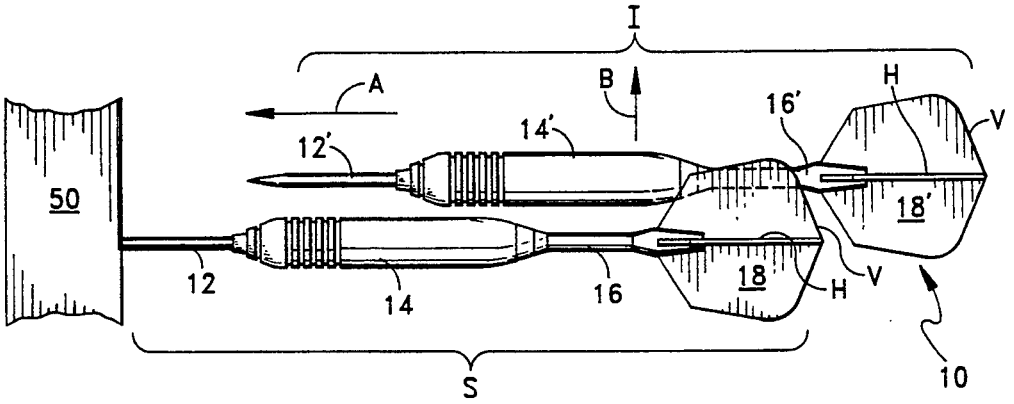
FIG. 1 (PRIOR ART)
FIG. 1 is a side view of a close grouping of two throwing darts employing dart flights of the prior art.

Referring to FIG. 1, a side view of a close grouping of two darts employing dart flights of the prior art is shown. As can be seen, stationary dart S has already been thrown and now resides in target 50 which may be a typical dart board, such as a bristle board. In the prior art configuration of FIG. 1, incoming dart I is thrown toward target 50 in close proximity to dart S in a trajectory generally referenced by the letter "A". The dart flight 10 of the prior art includes a vertical component V as well as a horizontal component H. The two vane components are typically positioned at right angles from one another to form a cross in cross-section. As incoming dart I approaches target 50, flight 18' of dart I approaches dart flight 18 of stationary dart S. When dart I further approaches target 50 along path A, either one or both of the horizontal and vertical components of dart flight 18' will communicate with either one or both of the horizontal and vertical vane components of dart flight 18 of stationary dart S. When this occurs, dart flight 18' will ride on dart flight 18 causing dart I to deviate from path A. For example, the communication of dart flight 18' and dart flight 18 can cause dart I to shift upward in a vertical direction indicated by the letter B. As a result of the deflection caused by the interference between flights 18' and 18 causes dart I to deviate from its intended path and miss the desired target.

Figure 2:
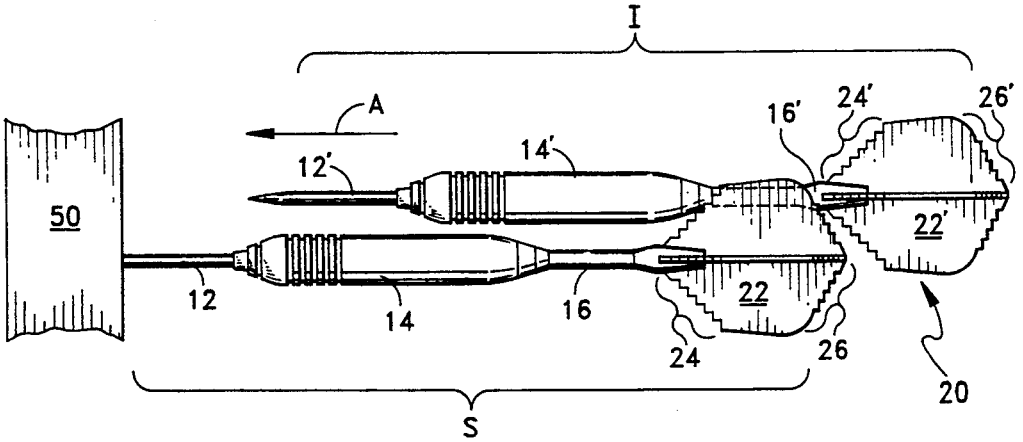
FIG. 2 is a side view of a close grouping of two throwing darts employing dart flights of the present invention.
Figure 5:
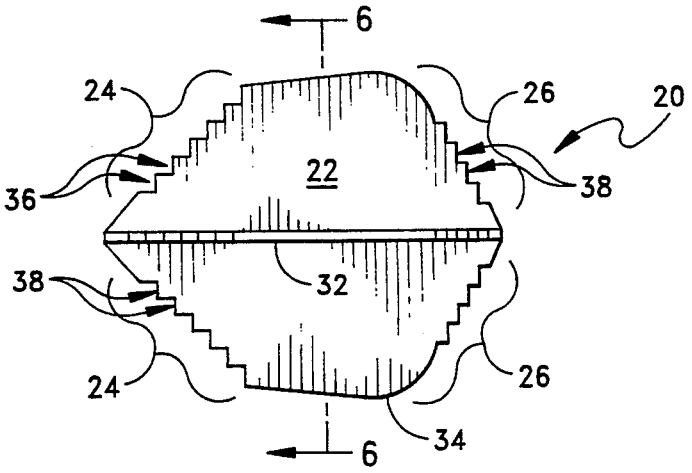
FIG. 5 is a side view of the dart flight of the present invention.
Figure 6:
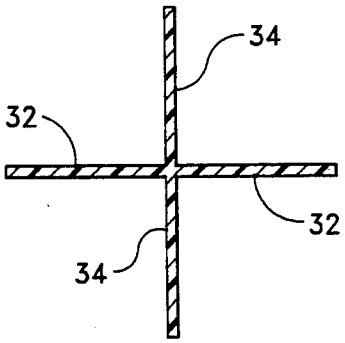
FIG. 6 is a cross-sectional view through line 6—6 of FIG. 5.

Turning now to the present invention shown in FIG. 2, a previously thrown dart which resides in target 50 is referenced by the letter S. Incoming dart is shown on flight path A toward target 50 and in close proximity to stationary dart S. In FIG. 2, both dart S and dart I are equipped with the dart flight 20 of the present invention. As seen in detail in FIGS. 5 and 6, the improved dart flight of the present invention generally includes a horizontal vane component 32 and a vertical vane component 34. In FIG. 6, horizontal vane component 32 is preferably positioned at approximately 90 degrees from vertical vane component 34 to form a cross. Referring back to FIG. 5, a side view of the dart flight of the present invention is shown. Dart flight 20 includes leading edges 24 on both the vertical vane component as well as the horizontal vane component. Trailing edges 26 are also provided on both the vertical vane component and the horizontal vane component. Each of the leading edges and trailing edges include notches 36 which preferably form a stepped configuration. However, other notched configurations may be employed. As a result of this stepped configuration, each notch includes a vertical surface 38 which is substantially perpendicular to flight path A of a thrown dart.

Turning back to FIG. 2, as incoming dart I approaches target 50, dart flight 22' approaches dart flight 22 of dart S. In the event that incoming dart I is in close proximity to dart S, at least one of leading edges 24' will communicate with at least one of the trailing edges 26 of dart flight 22.

Figure 3:
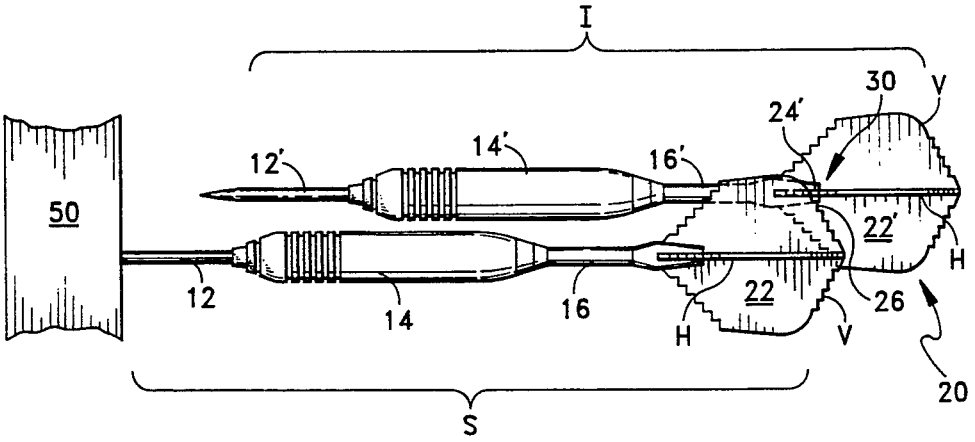
FIG. 3 is a side view of a close grouping of two throwing darts employing dart flights of the present invention where the leading edge of the incoming dart is communicating with the trailing edge of the dart already in the target.

FIG. 3 illustrates the point of contact of dart flight 22' with the dart flight 22 of stationary dart S. In this situation, for example, dart flight 22' contacts dart flight 22 prior to dart tip 12' reaching target 50. It can be seen that horizontal vane component 24' contacts vertical vane component 26 on the trailing edge of dart flight 22 at region 30.

Figure 4:
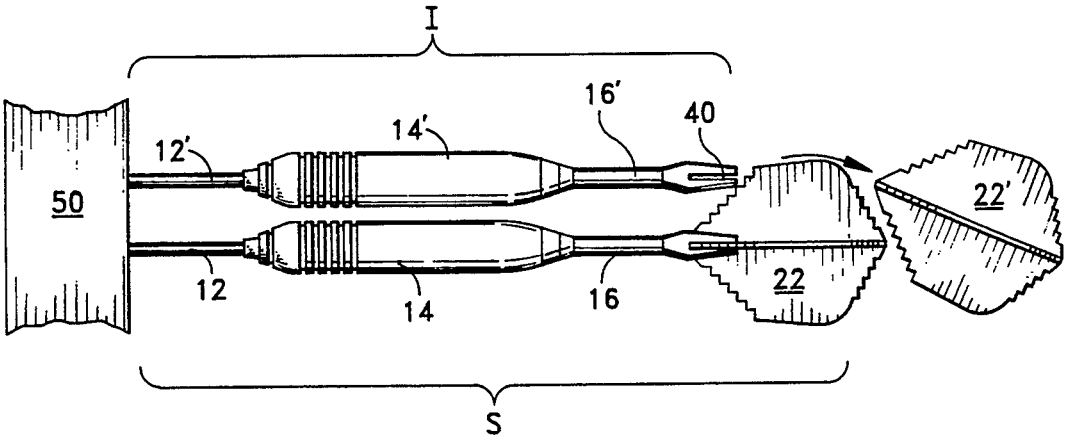
FIG. 4 is a side view of a close grouping of two throwing darts employing the dart flights of the present invention showing the dart flight of the incoming dart being ejected to prevent alteration of the flight path of the incoming dart.

As incoming dart I moves toward target 50, a vertical edge 38 on the leading edge, either on the horizontal or vertical vane component, will contact a vertical edge 38 on the trailing edge of a vertical or horizontal vane component on dart flight 22. Such communication of vertical edges 38 on the leading edge of incoming dart I and the trailing edge of dart S causes dart flight 22' to cease further movement along flight path A. However, tip 12', body 14' and shaft 16' continue to move along trajectory path A. As a result, dart flight 22' is unseated from the friction fit within slits 40 and shaft 16'. Without the stepped configuration of the present invention, it is not likely that a dart flight can be unseated against the forces of the friction fit with the shaft 16'. As seen in FIG. 4, dart flight 22' is ejected from shaft 16'. Since dart flight 22' is ejected completely off of shaft 16' due to the unique mating communication of the leading and trailing stepped edges, dart flight 22' of incoming dart I will not ride on dart flight 22 of dart S to cause dart flight path A to be altered. No deflection of incoming dart I will occur thereby preventing unwanted deflections.

It should be understood that the dart flight of the present invention is preferably manufactured of plastic but may also be made of material such as nylon and the like. Further, the overall size, weight and dimension is preferably commensurate with those found in known dart flights. As can be seen in FIG. 5, the stepped portion of the overall dart flight is small enough not to effect the weighting or flight characteristics of a given dart. As a result, a dart player may simply replace his or her conventional dart flight with a dart flight of the present invention and perceive no change in flight characteristics.

It will be appreciated by those skilled in the art that various changes and modifications can be made to the illustrated embodiments without departing from the spirit of the present invention. All such modifications and changes are intended to be covered by the appended claims.

I claim:

1. An improved throwing dart flight for connection to a dart body of a throwing dart for throwing at a target, comprising:

a plurality of vane components emanating from a central axis; each of said vane components having a leading edge and an trailing edge relative to the trajectory path of the throwing dart; said dart flight being slidably insertable into said dart body and capable of being retained therein by a friction fit;

each leading edge of said vane components having a plurality of notches therein;

each trailing edge of said vane components having a plurality of notches therein; and whereby said dart flight is separated from said dart body upon communication of a leading edge of a dart flight of an incoming thrown dart with a trailing edge of a dart flight of a dart present in said target.

2. The improved throwing dart flight of claim 1, wherein said notches form a stepped configuration along the leading edges and trailing edges of each of said vane components of said dart flight.

3. The improved throwing dart flight of claim 2, wherein each notch in said stepped configuration includes a vertical edge substantially perpendicular to said central axis and a horizontal edge substantially parallel to said central axis.

* * * * *